United States Patent [19]

Friess

[11] Patent Number: 4,485,891

[45] Date of Patent: Dec. 4, 1984

[54] EMERGENCY ESCAPE SYSTEM

[76] Inventor: Philip A. Friess, 857 Wheel Rd., Bel Air, Md. 21014

[21] Appl. No.: 305,602

[22] Filed: Sep. 25, 1981

[51] Int. Cl.[3] ..... A62B 1/02

[52] U.S. Cl. ..... 182/9; 182/82; 182/238

[58] Field of Search ..... 182/9, 191, 192, 82, 182/233, 238, 3; 248/246, 245, 228, 72, 340, 323; 105/154, 148; 104/95, 89; 188/42, 290

[56] References Cited

U.S. PATENT DOCUMENTS

| | | | |
|---|---|---|---|
| 2,229,015 | 1/1941 | King | 105/154 |
| 2,420,360 | 5/1947 | Deming | 48/38 |
| 2,435,418 | 2/1948 | Wright | 188/42 |
| 2,645,187 | 7/1953 | Guadagna | 105/154 |
| 2,926,880 | 3/1960 | Bourgeois | 248/228 |
| 3,314,636 | 4/1967 | McHugh | 248/340 |
| 3,335,469 | 8/1967 | Shand et al. | 24/126 |
| 3,410,364 | 11/1968 | Fountain | 182/9 |
| 3,568,605 | 3/1971 | Pettit | 105/154 |
| 3,674,116 | 7/1972 | Vogeli | 188/67 |
| 4,093,186 | 6/1978 | Golden | 254/156 |
| 4,121,689 | 10/1978 | Bonvin | 182/3 |
| 4,215,772 | 8/1980 | Graham | 188/290 |
| 4,406,349 | 9/1983 | Vilchek | 182/82 |

FOREIGN PATENT DOCUMENTS

| | | | |
|---|---|---|---|
| 233422 | 5/1925 | United Kingdom | 248/246 |
| 2059894 | 4/1981 | United Kingdom | 104/95 |

*Primary Examiner*—Reinaldo P. Machado
*Assistant Examiner*—Alvin Chin-Shue
*Attorney, Agent, or Firm*—William B. Noll

[57] ABSTRACT

The invention herein described is directed to an emergency escape system, such as for use in exiting from a high-rise building. Such system includes a personnel lowering device adapted to be clamped to a vertically mounted I-beam running the full height of the building from which a quick escape is desired. The lowering device, which controls the rate of descent of the user thereof through a contained braking system, includes a (1) spring-biased pivotal clamping mechanism, activated by contact with the outer face of the I-beam, and (2) knurled roller which rolls along said face and drives two drums enclosed in a viscous fluid, such as silicon oil having a viscosity of 300 SSU. As the rate of descent of the lowering device begins to increase through gravity and the weight of the descending personnel, drum RPM increases and fluid shear increases. In a short period of time after the descent begins the fluid shear forces on the roller driven drums are balanced such that the rate of descent is controlled.

4 Claims, 5 Drawing Figures

EMERGENCY ESCAPE SYSTEM

BACKGROUND OF THE INVENTION

This invention relates to an emergency escape system which permits a rapid but safe exit from high-rise structures. The system is particularly suited for a rapid escape from a burning building where access to stairs is blocked by smoke or flame.

The need for a safe and effective system, especially one that does not rely upon the physical prowess or strength of the party seeking to escape a burning building, has been recognized for many years. As larger buildings are constructed, often with less than adequate means to escape from the uppermost floors thereof, the need becomes more acute.

U.S. Pat. No. 3,826,341 to Ledner describes an emergency descent device which includes a houring containing a tortuous path through which a vertically extending strand is drawn as the housing moves downwardly along the strand. An automatic braking mechanism, acting upon such strand, is included in the housing and is deactivated by the user to control the movement of the housing down the strand.

Similar and perhaps less complex devices have been known for years. Certain of these early devices and the problems associated therewith are described by Ledner in his patent in this manner.

1. U.S. Pat. No. 300,090 to Larson et al. shows a device in which a strand of rope is directed through a tortuous path housing and the rate of descent along such rope is controlled by cam levers which may be actuated by the escaping party or by someone on the ground, or by someone in an adjacent building.

2. U.S. Pat. No. 722,713 to Johnson shows another device which permits the operator to descent along a strand while controlling his speed with a pair or rope gripping jaws.

3. U.S. Pat. No. 812,950 to Price shows yet another tortuous path escape device with a friction brake which permits control of the speed in only one direction along the strand.

4. U.S. Pat. No. 933,685 to Wray illustrates an escape system which permits movement in either direction along the strand and includes separate friction brakes for control of movement in the opposing directions.

5. U.S. Pat. No. 1,059,754 to Paquet depicts yet another toruous path fire escape in which the strand is directed along a helical path through the housing and may be engaged by the operator with hand operated friction brakes which control the rate of descent in either direction.

6. U.S. Pat. No. 1,497,534 to Bass shows an escape device in which the strand is led around a friction roller and past hand actuated brake devices at either end of the housing.

7. U.S. Pat. No. 2,544,694 to Phelan discloses a fire escape apparatus in which the strand is directed around a stationary sheave, through a pair of braking devices for controlling the rate of movement in one direction along the strand.

8. U.S. Pat. No. 3,674,116 to Vogeli teaches a fall-prevention device from a fixed structure rather than a controlled movement escape system. However, the patent illustrates an interesting concept of a device which operates in conjunction with a fixed path in the form of a C-shaped channel member. A slide member, to which a person may attach himself, is locked against movement by a cam which causes the slide member to grip the channel member.

Various problems are associated with each of the above devices. For example, a person using such devices is required to actuate the devices using levers separate from the grips on which such person would normally steady himself during his descent. Also, the effectiveness of the speed controls in many instances depends upon the strength of the person who applies the control. Many of such devices have the obvious disadvantages of requiring a conscious person, and in many cases a strong and/or heavy one. However, in a situation where the escaping person is unconscious, elderly or a frightened infant, such prior art devices are ineffective.

Finally, a major disadvantage of many of the devices is the inability to readily reuse the escape or descent system. The present invention recognizes the need to provide a safe and effective means of escape for all parties irrespective of their physical state or age. Such means will become apparent from the specification which follows.

SUMMARY OF THE INVENTION

It is a principle object of the present invention to provide a safe and effective means for a person, whether conscious or not, to escape from the uppermost floors of a structure such as a high-rise building. The means to accomplish such escape includes a personnel lowering device adapted to be clamped to a vertically mounted I-beam running the full height of the building from which a quick escape is desired. The lowering device, which controls the rate of descent by the user thereof through a contained braking system, includes a (1) spring-biased pivotal clamping mechanism, activated by contact with the outer face of the I-beam and (2) knurled roller which rolls along said face and drives two drums enclosed in a viscous fluid, such as silicon oil having a viscosity of about 300 SSU. As the rate of descent of the lowering device begins to increase through gravity and the weight of the descending personnel, drum RPM increases and fluid shear increases. In a short period of time after the descent begins the fluid shear forces on the roller driven drums are balanced such that the rate of descent is controlled. The escape is effected safely without having to be activated or controlled by the user thereof.

DETAILED DESCRIPTION OF PREFERRED EMBODIMENT

Figure 1:
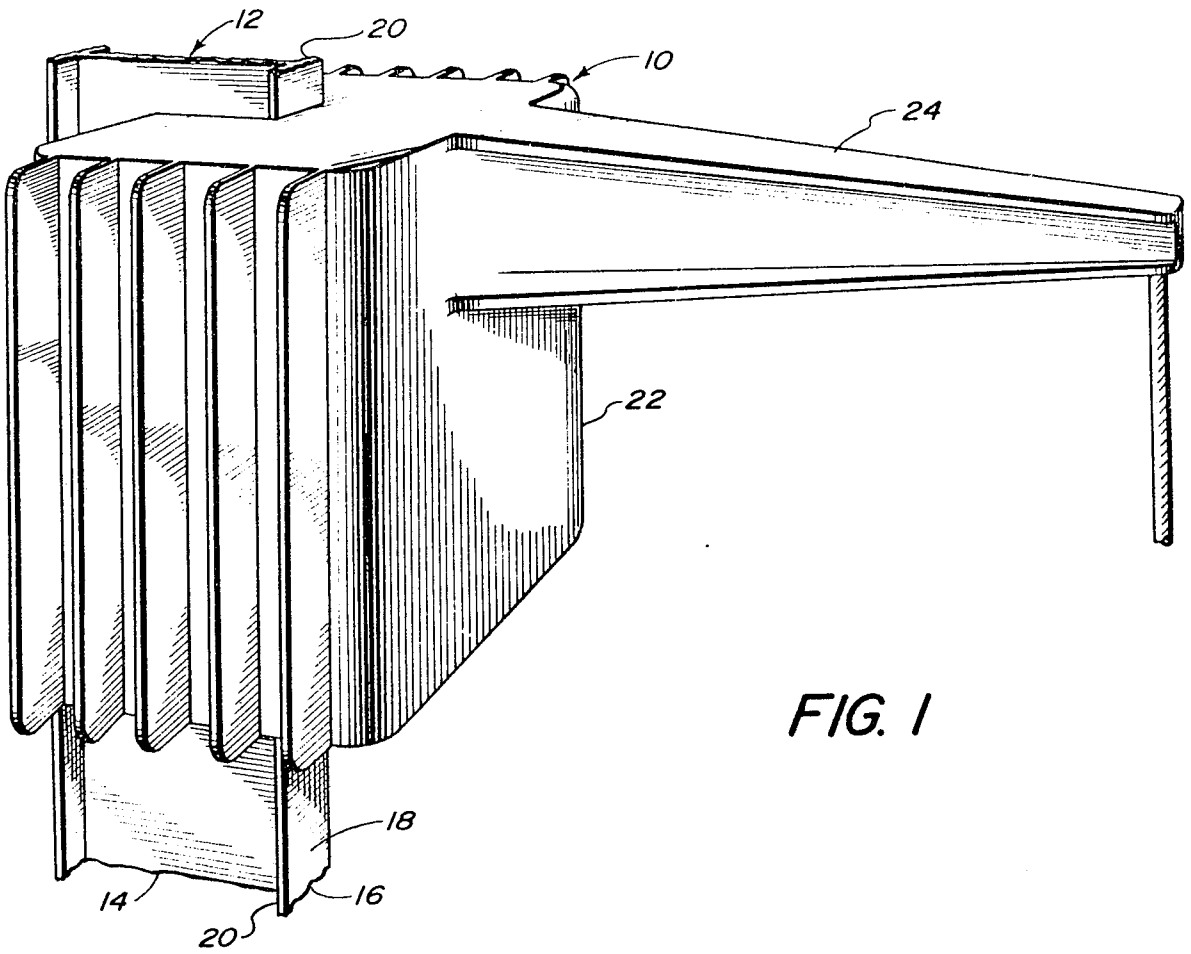
FIG. 1 is a perspective view of an emergency escape system according to this invention.

The emergency escape system of this invention illustrated in the several FIGURES hereof, comprises in combination a personnel lowering device 10 adapted to be clamped to a vertically mounted I-beam 12, which beams forms the fixed path of descent for the lowering device 10. The I-beam 12 can be continuous or formed of a plurality of aligned sections.

I-beam 12, as known in the metal forming art, is characterized by a web portion 14 and a flange 16, said flange having an outer surface or face 18 and opposite or inner faces 20. The significance of these features of the I-beam 12 will become apparent during the following description regarding the lowering device 10.

The lowering device 10 comprises housing 22 formed of a light-weight metal or plastic. Preferably, though not limited thereto, housing 22 is provided with projecting arm 24 from which a harness (not shown) may be suspended. The harness, or a similar device for safely supporting a person to be lowered by device 10, by virtue of the length of the projecting arm 24, prevents such person from being bumped or scraped during his descent along I-beam 12.

Figure 3:
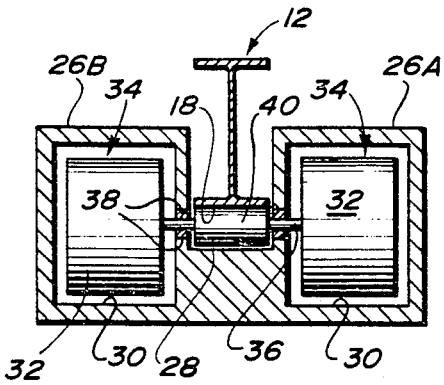
FIG. 3 is a sectional view taken along line 3—3 of FIG. 2.

As best illustrated in FIG. 3, the housing as viewed from the top is U-shaped having identical arm portions 26A and 26B. The connecting or intermediate portion 28 is sized to receive the flange 16 of I-beam 12.

Each arm portion 26A and 26B is provided with a chamber 30. Within each chamber 30 there is a drum 32 which is adapted to freely rotate within its chamber 30. Filling the void inside the chamber 30 is a highly viscous fluid 34. Connecting the respective drums 32 is a drive shaft 36 suitably journaled and sealed 38 within the housing 22. Centrally positioned along the drive shaft 36 is knurled roller 40, which in an operative position is in contact with I-beam outer face 18. As the lowering device 10 descends along the I-beam 12, the roller 40 drives the drums 32 which are encased in the viscous fluid 34. As the rate of descent increases, drum RPM increases and fluid shear of the viscous fluid increases. That is, the fluid through friction provides a braking action to said drums. In a short time fluid shear forces on the drums 32 balance those on the roller 40 and the user of device 10 descends at a constant rate. A silicon oil having a viscosity of about 300 SSU may be used as the fluid 34. However, it should be understood that modifications, such as changes in the drum diameter or width, fluid volume or providing vanes on the periphery of said drums, may be employed as a means to modify the system of this invention to provide the most acceptable rate of descent.

Figure 5:
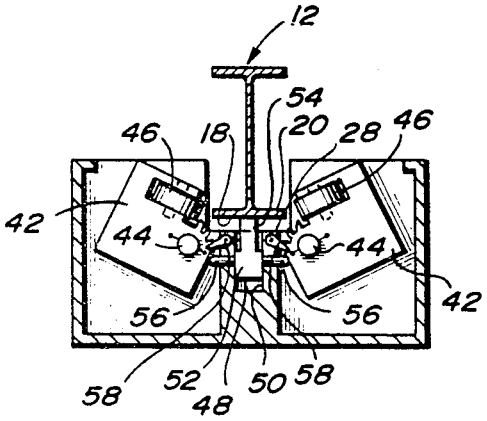
FIG. 5 is a sectional view similar to FIG. 4 but showing the system in an inoperative position.

To secure contact between the housing 10 and the I-beam 12 during such descent, means have been provided in the system of this invention. Such means, just prior to activation, are illustrated in an inoperative position in FIG. 5. Pivotal clamping jaws 42, shown in an inoperative position in FIG. 5, are mounted for limited rotation about vertical pins 44. Each pivotal clamping jaw 42 is provided with a roller 46, which when placed in an operative or secured position, contact an inner face 20.

Figure 4:
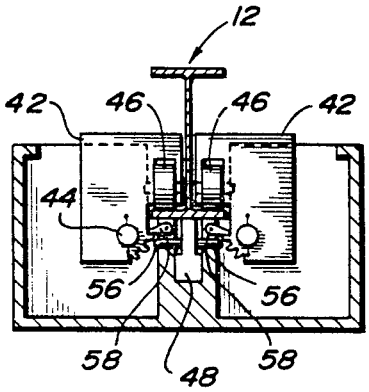
FIG. 4 is a sectional view taken along line 4—4 of FIG. 2.

Since little time may be available to the potential user of the lowering device 10, a fast but effective means must be provided to move the pivotal clamping jaw 42 from an inoperative (FIG. 5) to an operative position (FIG. 4), that is from a location remote from I-beam 12 to one secured thereto. As illustrated in FIG. 5, a T-shaped jaw release pin 48 is provided in the intermediate portion 28. Such pin 48 is sized to seat in the cavity 50 when brought in contact with outer face 18. It will be noted that the jaw release pin 48 is formed of two parts, a larger section 52 and a smaller section 54. As the lowering device 10 is brought into contact with I-beam outer face 18 jaw release pin 48 is pushed into cavity 50.

Jaw pins 56, one for each pivotal clamping jaw 42, are spring-biased toward one another but are held in position by jaw release pin 48. In said latter position, the jaw pins 56 prevent any pivotal movement by clamping jaws 42. However, as the jaw release pins 48 moves into cavity 50 the jaw pins 56 slide along the release pin 48 from the larger section 52 to the smaller section 54. Such action releases the clamping jaws 42, which are spring loaded, permitting such jaws to pivot about the flange 16 thereby bringing the rollers 46 into contact with inner flange faces 20. A ratchet 58 for each clamping jaw 42 is provided to prevent a premature pivoting of such jaw during use of the escape system of this invention.

Figure 2:
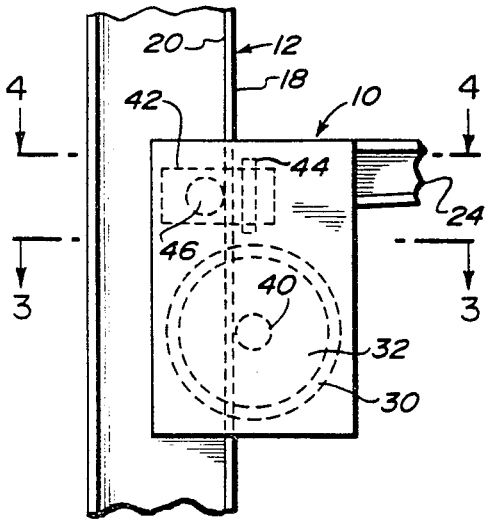
FIG. 2 is a side view of the emergency escape system of FIG. 1 showing the relationship of certain internal components of said system.

The spaced relationship between lowering device's (1) drive mechanism and (2) clamping mechanism, are shown in FIG. 2. In the operation of such device, as viewed in FIG. 2, it will be seen that the weight of the user acting on projecting arm 24 will create a clockwise moment about the housing 22 thereby insuring full contact between roller 40 and outer face 18, as well as rollers 46 and the inner faces 20. As a result of said relationship, which maintains constant contact between the drive mechanism and the I-beam, a smooth and safe descent is assured.

It should be understood that modifications may be made in the construction of the emergency escape system of this invention without departing from the spirit and scope thereof. Accordingly, no limitation is intended to be imposed on such invention except as set forth in the appended claims.

I claim:

1. A personnel escape system for exiting a high fixed structure, comprising in combination with a rail extending over a fixed vertical distance along said structure, a personnel lowering member adapted to clamp onto said rail for controlled descent thereof at a predetermined maximum rate of descent, said member including (a) a housing containing a clamping mechanism which is adapted to permit said housing to be attached for movement along one surface of said rail, (b) a knurled roller in rolling contact with said one surface, (c) a drum driven by and rotatable with said roller, where said drum is enclosed within a viscous fluid and mounted in said housing, and (d) means to attach a harness arrangement to said housing capable of holding said personnel during descent from the structure, whereby such controlled rate of descent is achieved by limiting the rate of rotation of said drum through the action of said viscous fluid on said drum.

2. The system according to claim 1 characterized in that said clamping mechanism comprises a pair of spring-biased members having rollers adapted to contact a different surface of said rail at any point along said rail.

3. The system according to claim 2 characterized in that said spring-biased members are movable from a remote position to a position in contact with said rail at any point along said rail.

4. The system according to claim 3 characterized in that said movement of said spring-biased members is activated by a slide member depressed through contact with said rail.

* * * * *